US010392879B2

(12) United States Patent
Wood

(10) Patent No.: US 10,392,879 B2
(45) Date of Patent: Aug. 27, 2019

(54) TONG ASSEMBLY WITH TORQUE MEASUREMENT

(71) Applicant: Weatherford Technology Holdings, LLC, Houston, TX (US)

(72) Inventor: Kevin Wood, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 15/574,952

(22) PCT Filed: May 5, 2016

(86) PCT No.: PCT/US2016/030992
§ 371 (c)(1),
(2) Date: Nov. 17, 2017

(87) PCT Pub. No.: WO2016/191067
PCT Pub. Date: Dec. 1, 2016

(65) Prior Publication Data

US 2018/0171729 A1 Jun. 21, 2018

Related U.S. Application Data

(60) Provisional application No. 62/167,644, filed on May 28, 2015.

(51) Int. Cl.
*E21B 19/00* (2006.01)
*E21B 19/16* (2006.01)

(52) U.S. Cl.
CPC ..... *E21B 19/161* (2013.01); *E21B 19/166* (2013.01)

(58) Field of Classification Search
CPC ..... E21B 19/166; E21B 19/161
See application file for complete search history.

(56) References Cited

U.S. PATENT DOCUMENTS 4,290,304 A * 9/1981 Eckel ..... E21B 19/164 73/862.25
4,574,664 A 3/1986 Curry
5,081,888 A * 1/1992 Schulze-Beckinghausen ..... E21B 19/16 81/57.16

(Continued)

FOREIGN PATENT DOCUMENTS

CN 102278083 A 12/2011
WO 1992006822 A1 4/1992

OTHER PUBLICATIONS

International Search Report and Written Opinion, PCT/US2016/034734, dated Oct. 18, 2016.

(Continued)

*Primary Examiner* — Jamel E Williams
(74) *Attorney, Agent, or Firm* — Patterson + Sheridan, LLP

(57) ABSTRACT

The present disclosure generally relates to a tong assembly for making up and breaking out a tubular connection such as a connection between two tubulars in a tubular string. The tong assembly includes a power tong, a backup tong and a load transfer assembly connected between the power tong and the backup tong. The load transfer assembly comprises a torque bar and one or more sensors to measure a torque exerted on the torque bar. The torque measurements of the torque bar may be used to monitor the torque exerted on the tubular string by the tong assembly.

20 Claims, 6 Drawing Sheets

(56) References Cited

U.S. PATENT DOCUMENTS

| | | | | |
|---|---|---|---|---|
| 8,235,104 | B1 * | 8/2012 | Sigmar | E21B 19/164<br>166/380 |
| 2004/0237726 | A1 * | 12/2004 | Schulze Beckinghausen | E21B 19/164<br>81/57.34 |
| 2011/0030512 | A1 * | 2/2011 | Begnaud, Jr. | E21B 19/164<br>81/57.34 |
| 2016/0333650 | A1 * | 11/2016 | Berrier | E21B 19/165 |
| 2018/0120183 | A1 * | 5/2018 | Ruehmann | E21B 19/166 |
| 2018/0142524 | A1 * | 5/2018 | Rothe | E21B 19/161 |
| 2018/0171729 | A1 * | 6/2018 | Wood | E21B 19/166 |
| 2019/0078402 | A1 * | 3/2019 | Domec | E21B 19/166 |

OTHER PUBLICATIONS

EPO Office Action dated Sep. 28, 2018, for European Patent Application No. 16722513.5.

* cited by examiner

TONG ASSEMBLY WITH TORQUE MEASUREMENT

BACKGROUND OF THE DISCLOSURE

Field of the Disclosure

The present disclosure generally relates to methods and apparatus for making up and breaking out tubular connections. More particularly, embodiments of the present disclosure relate to a tong assembly for use in making up or breaking out tubular connections within a tubular string of an oil or gas well.

Description of the Related Art

Construction of oil or gas wells usually requires making long tubular strings that make up casing, risers, drill pipe or other tubing. Due to the length of these strings, sections or stands of tubulars are progressively added to or removed from the tubular strings as they are lowered or raised from a drilling platform. A tong assembly is commonly used to make up or break out joints in the tubular strings.

It is desirable that the tong assembly applies a predetermined torque to the joint to prevent the joint from being too loose or too tight. Torque applied to the tubular has been monitored by measuring a force of compression or tension exerted on a component of a tong assembly and converting the measured force to torque. However, movements of the tong assembly during make up may cause misalignment of the force measuring sensors, thus, compromising accuracy of the force measurement. Additionally, accuracy of the torque measurement converted from a force measurement is also susceptible to size variations of the tubulars.

Therefore, there is a need for a tong assembly with improved torque measurement.

SUMMARY OF THE DISCLOSURE

The present disclosure generally relates to a tong assembly for making up and breaking out a tubular connection such as a connection between two tubulars in a tubular string.

One embodiment provides an apparatus for handling a first tubular and a second tubular during make up and break out operations. The apparatus includes a power tong for gripping the first tubular and rotating the first tubular about a central axis, a backup tong for gripping the second tubular and preventing rotation of the second tubular, and a load transfer assembly connected between the power tong and the backup tong. The load transfer assembly comprises a torque bar. The torque bar comprises a load cell disposed on a longitudinal axis of the torque bar. The load cell is positioned to measure a torque exerted the torque bar about the longitudinal axis.

Another embodiment provides a method for making up or breaking out a tubular connection. The method includes engaging a first tubular with a power tong and engaging a second tubular with a backup tong. The power tong and the backup tong are connected by a load transfer assembly. The load transfer assembly comprises a torque bar and a load cell disposed on a longitudinal axis of the torque bar. The method further includes rotating the first tubular about a central axis relative to the second tubular using the power tong to make up or break out a connection between the first and second tubular, measuring a torque exerted on the torque bar using the load cell disposed on the torque bar.

Another embodiment provides a tong assembly comprising a power tong, a backup tong, and a load transfer assembly coupled between the power tong and the backup tong. The load transfer assembly comprises a first bell crank pivotably coupled to the power tong and the backup tong, a second bell crank pivotably coupled to the power tong and the backup tong, a torque bar having a first end attached to the first bell crank and a second end attached to the second bell crank, and one or more sensors positioned to measure to a torque exerted on the torque bar about a longitudinal axis of the torque bar.

One embodiment of the present disclosure provides an apparatus for handling a first tubular and a second tubular during make up and break out operations. The apparatus includes a power tong for gripping the first tubular and rotating the first tubular about a central axis, a backup tong for gripping the second tubular, and a load transfer assembly connected between the power tong and the backup tong, wherein the load transfer assembly comprises a torque bar and a load cell configured to measure a torque exerted on the first tubular.

Another embodiment of the present disclosure provides a method for making up or breaking out a tubular connection. The method includes engaging a first tubular with a power tong, engaging a second tubular with a backup tong. The power tong and the backup tong are connected by a load transfer assembly. The load transfer assembly comprises a torque bar and a load cell. The method further includes rotating the first tubular about a central axis relative to the second tubular using the power tong to make up or break out a connection between the first and second tubulars, and measuring a torque exerted on the torque bar using the load cell.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

The present disclosure generally relates to a tong assembly for making up and breaking out a tubular connection such as a connection between two tubulars in a tubular string. The tubular strings may be made of tubulars that form risers, casings, drill pipes or other tubings in oil and gas wells. Embodiment of the present disclosures relates to a tong assembly includes a power tong, a backup tong and a load transfer assembly connected between the power tong and the backup tong. The load transfer assembly comprises a torque bar and one or more sensors to measure a torque exerted on the torque bar. The torque measurements of the torque bar may be used to monitor the torque exerted on the tubular string by the tong assembly.

Figure 1A:
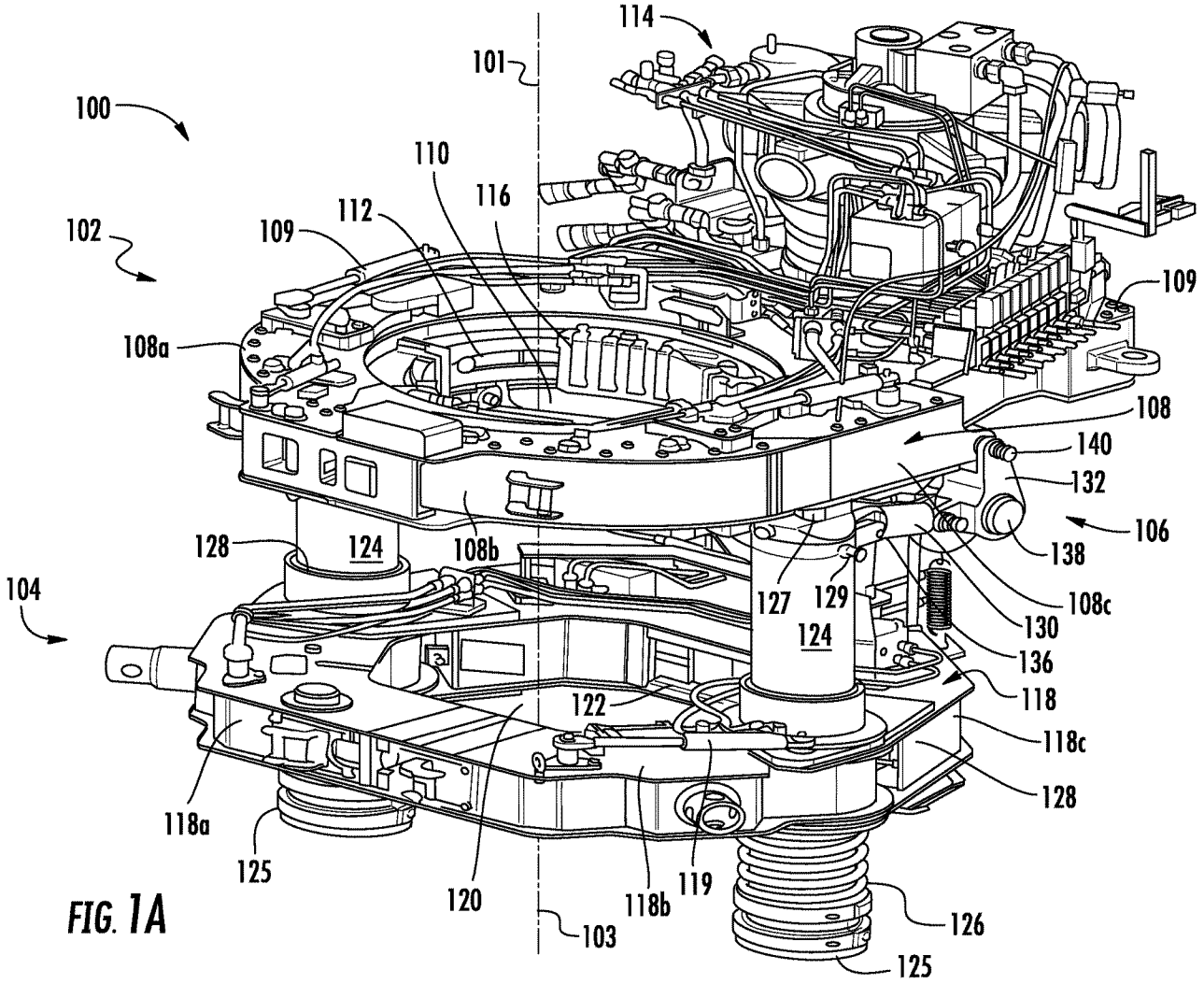
FIG. 1A is a schematic perspective view of a tong assembly according to one embodiment of the present disclosure.
Figure 1B:
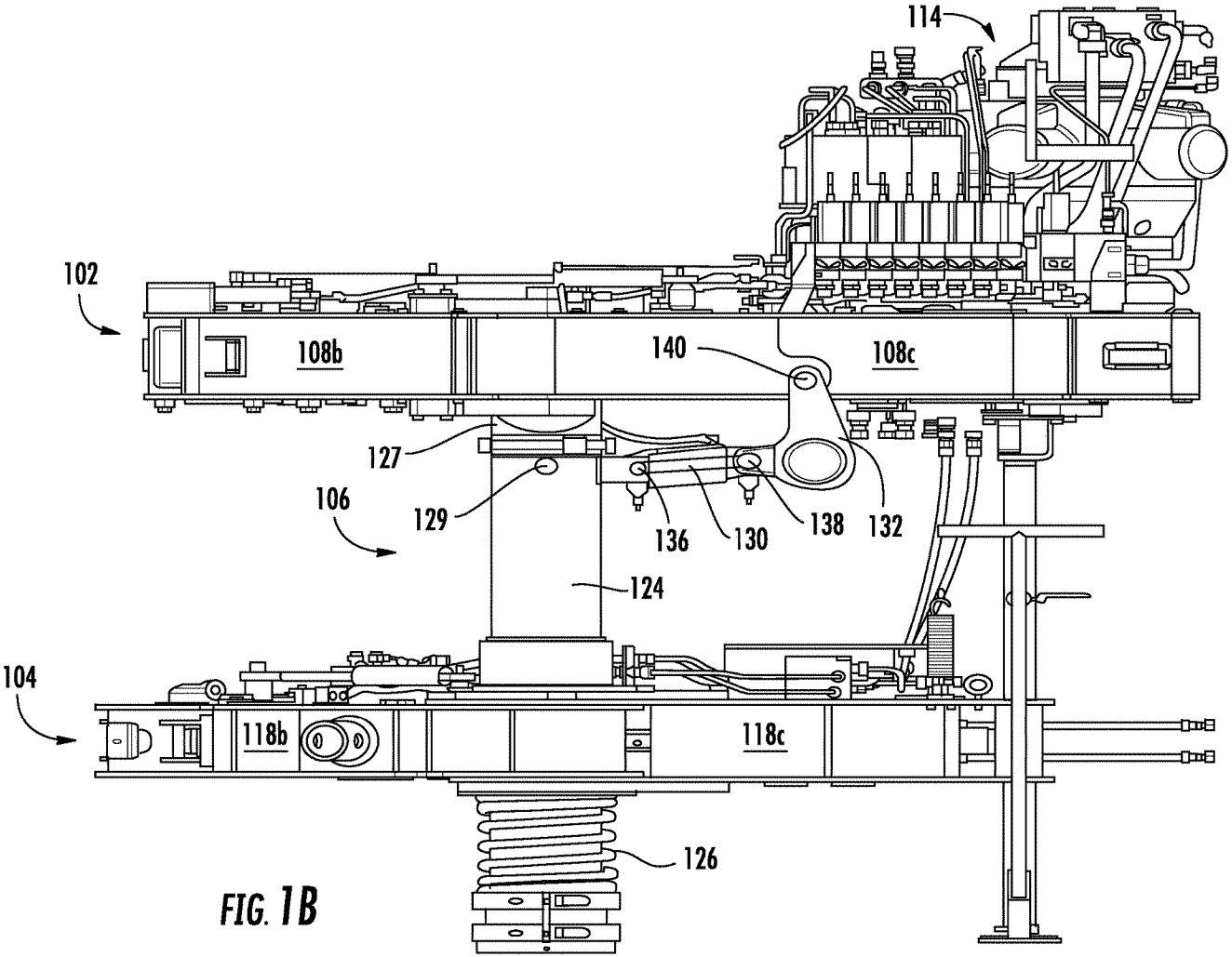
FIG. 1B is a schematic side view of the tong assembly of FIG. 1A.

FIG. 1A illustrates an embodiment of a tong assembly 100 according to one embodiment of the present disclosure. FIG. 1B is a schematic side view of the tong assembly 100. The tong assembly 100 includes a power tong 102 and a backup tong 104. In operation, the power tong 102 may be suspended from a handling tool or supported by a stand. The power tong 102 and the backup tong 104 may be connected by a load transfer assembly 106.

The power tong 102 may include a frame 108 with a central opening 110 for receiving a tubular. The frame 108 may include two or more sections movable relative to each other to open and close the central opening 110. In one embodiment, the frame 108 may include two front sections 108*a*, 108*b* and one back section 108*c*. The front sections 108*a*, 108*b* are connected to the back section 108 by hinges and pivotable about the back section 108*c*. In one embodiment, the front sections 108*a*, 108*b* may be pivoted by pistons 109.

The power tong 102 may further include a rotor 112 disposed in the frame 108. The rotor 112 may be a segmented rotor. The rotor 112 may be coupled to a motor assembly 114. Jaws 116 may be attached to an inner diameter of the rotor 112. The jaws 116 may rotate with the rotor 112 to rotate a tubular about a central axis 101 during make up and break out of a tubular connection. The jaws 116 may move radially relative to the frame 108 to secure and release a tubular or to accommodate tubulars of various diameters. In one embodiment, the jaws 116 may be driven using a hydraulic circuit.

The backup tong 104 may be disposed underneath the power tong 102. The backup tong 104 may include a frame 118 with a central opening 120 for receiving a tubular. The frame 118 may include two or more sections movable relative to each other to open and close the central opening 120. In one embodiment, the frame 118 may include two front sections 118*a*, 118*b* and one back section 118*c*. The front sections 118*a*, 118*b* are connected to the back section 118 by hinges and pivotable about the back section 118*c*. In one embodiment, the front sections 118*a*, 118*b* may be pivoted by pistons 119. The backup tong 104 may include jaws 122 attached to the frame 118. The jaws 122 may move radially relative to the frame 118 to secure and release a tubular or to accommodate tubular of various diameters. In one embodiment, the jaws 122 may be driven using a hydraulic circuit.

The frame 118 of the backup tong 104 may be movably coupled to support legs 124. Lower ends 125 of the support legs 124 are configured to stand a platform or other stationary planes. The support legs 124 support the backup tong 104 and prevent the backup tong 104 from rotating during operation. In one embodiment, the frame 118 has through openings for receiving the support legs 124 therein. In one embodiment, the frame 118 may include sleeves 128 for receiving the support legs 124. In one embodiment, the frame 118 may be coupled to two support legs 124 that are symmetrically positioned about a central axis 103 of the backup tong 104. In one embodiment, the central axis 103 and central axis of the two support legs 124 may be within the same plane. Each support leg 124 may include a spring member 126 disposed at lower ends 125. Weight and vertical load of the backup tong 104 may rest on the spring members 126. The spring members 126 allow the backup tong 104 to be movable along the support legs 124 thus providing structure flexibility.

Figure 1C:
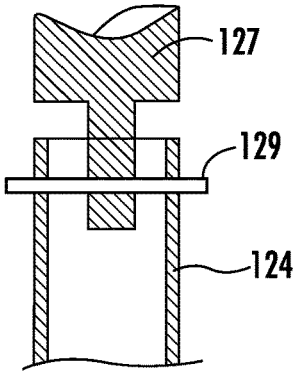
FIG. 1C is a schematic partial sectional view of a support leg of the tong assembly of FIG. 1A.

In one embodiment, the power tong 102 may include alignment posts 127 extending from a lower side of the frame 108. When the tong assembly 100 is assembled, the alignment posts 127 may be inserted into the support legs 124 so that the central axis 101 of the power tong 102 and the central axis 103 of the backup tong 104 may be substantially aligned (see FIG. 1C). The inner diameter of the support legs 124 is substantially larger than the outer diameter of the alignment posts 127 so that the power tong 102 may move relative to the backup tong 104 within a limited range without the alignment posts 127 contacting the support legs 124. When the alignment posts 127 do not contact the support legs 124, torsion and force are not transmitted between the support legs 124 and the alignment posts 127. In one embodiment, during assembly or transportation, pins 129 may be used to couple the alignment posts 127 to the support leg 124. However, during operation, the pins 129 are removed to allow relative movements between the power tong 102 and the backup tong 104 and avoid transmission of load between the alignment posts 127 and the support legs 124.

Figure 1D:
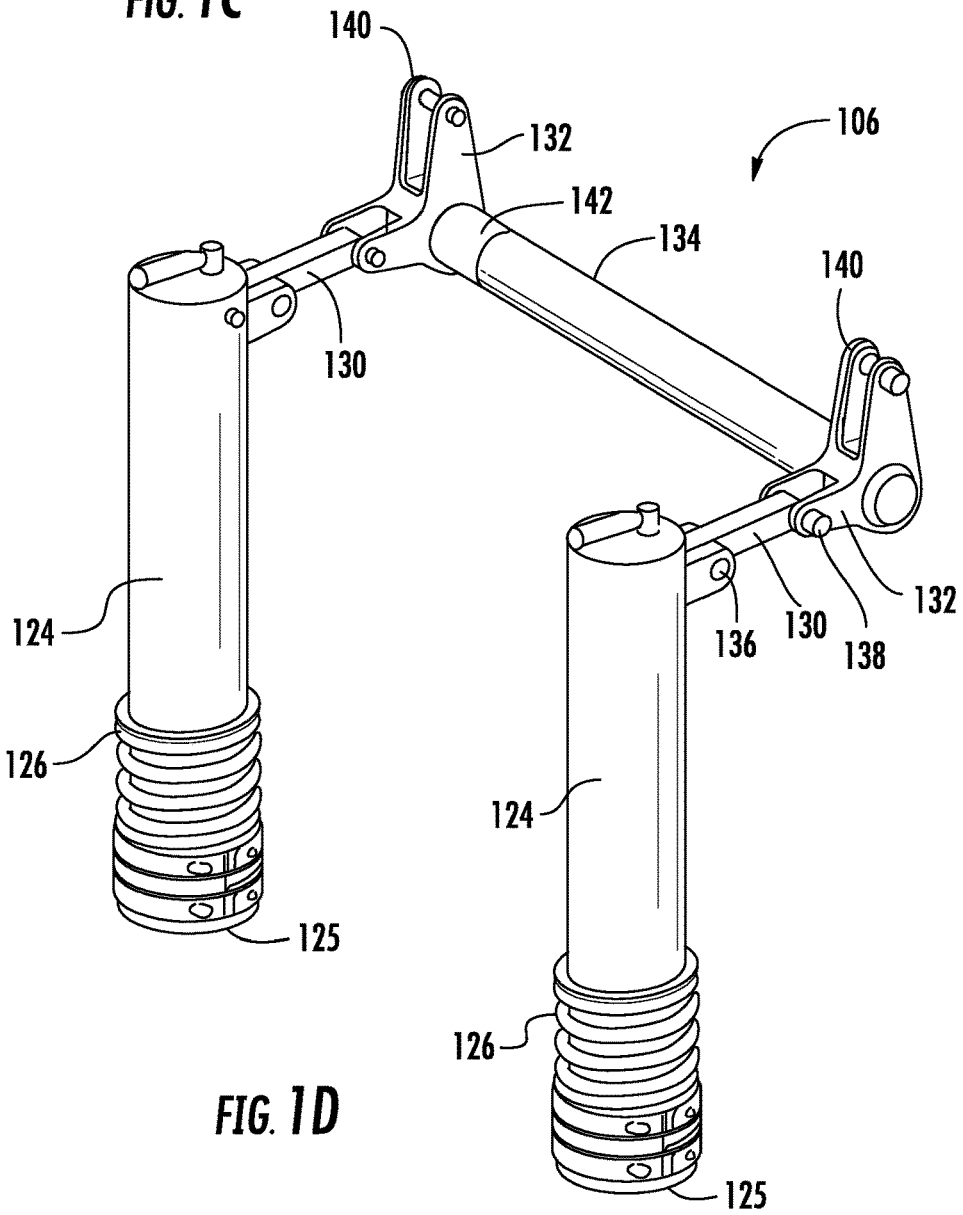
FIG. 1D schematically illustrates a load transfer assembly in the tong assembly of FIG. 1A.

The power tong 102 and the backup tong 104 are connected through the load transfer assembly 106. The load transfer assembly 106 may include two links 130, two bell cranks 132, and a torque bar 134 (see FIG. 1D). The links 130 are coupled between the support legs 124 and the bell cranks 132. Each link 130 is coupled to the corresponding support leg 124 by a pivot connection 136. Each link 130 is coupled to the corresponding bell crank 132 by a pivot connection 138. The two bell cranks 132 are joined together through the torque bar 134. In one embodiment, the bell cranks 132 may be fixedly coupled to the torque bar 134 at opposite ends of the torque bar 134. The bell cranks 132 are further coupled to the frame 108 of the power tong 102 by pivot connections 140.

According to embodiment of the present disclosure, the torque bar 134 includes a load cell 142 configured to measure the torque applied to the torque bar 134. In one embodiment, the load cell 142 may be integrated in a tubular body of the torque bar 134. In another embodiment, the load cell 142 may be attached to the torque bar 134. For example, the load cell 142 may be attached to one end of the torque bar 134 by splines or flanges. The load cell 142 directly measures the torque exerted on the torque bar 134.

The load transfer assembly 106 forms a load path for transferring torque between the power tong 102 and the backup tong 104. When power tong 102 applies a torque to rotate a first tubular causing a joint between the first tubular and a second tubular held by the backup tong 104 to tighten or loosen, the load transfer assembly 106, coupled to the power tong 102 and the backup tong 104, provides reaction torques and to prevent the power tong 102 from moving relative to the backup tong 104 along a horizontal plane.

During an operation, the tong assembly 100 is first moved to the location of the tubular string to be operated. The tong assembly 100 may be moved using an overhead handling tool or a track on the platform. The frames 108, 118 of the power tong 102 and the backup tong 104 may be in the open position to receive the tubular string in the openings 110, 120. For example, the front sections 108*a*, 108*b* and front sections 118*a*, 118*b* may be pivoted open while the tong assembly 100 is being moved. Once the tong assembly 100 is in position, i.e. the central axis 101 of the tong assembly 100 aligns with longitudinal axis of the tubular string. The front sections 108*a*, 108*b* and front sections 118*a*, 118*b* are then closed so that the jaws 116 and the jaws 122 may secure the tubular string. When the tong assembly 100 is in the position for making up or breaking out a connection, the tubular string is secured by the jaws 122 of the backup tong 104 and the tubular section to be joined or removed is secured by the jaws 116 of the power tong 102.

Figure 1E:
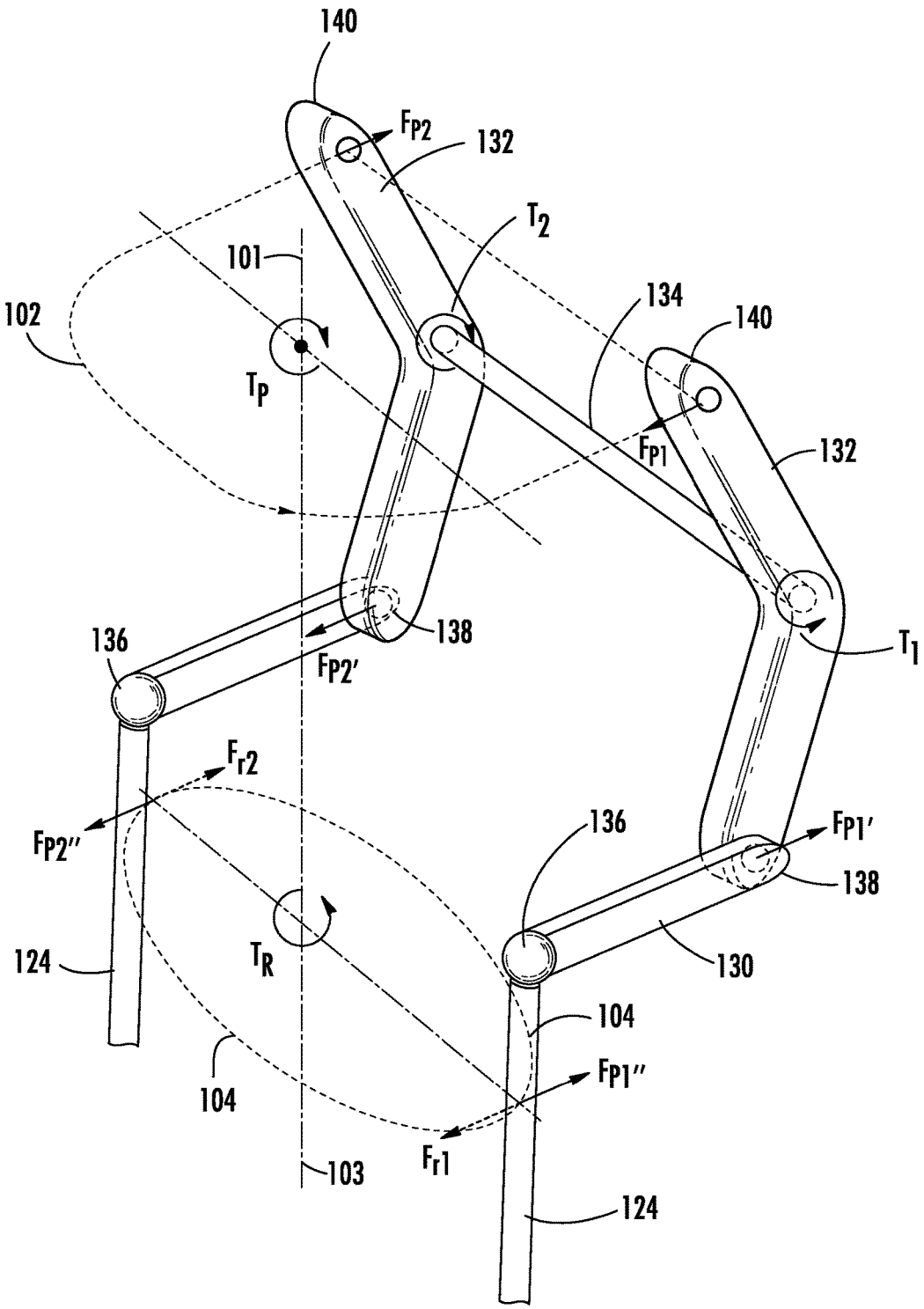
FIG. 1E schematically illustrates a load path in the tong assembly during operation.

FIG. 1E schematically illustrates a load path in the tong assembly 100 when making up a joint between a first tubular and a second tubular. To make up the joint, the first tubular is generally grounded to the work floor, for example by the slips for the work floor. The jaws 122 of the backup tong 104 clamp to the first tubular so that the backup tong 104 would not rotate while the jaws 116 of the power tong 102 clamp to the second tubular and rotate the second tubular relative to the first tubular.

In FIG. 1E, the power tong 102 rotates the second tubular clockwise. The torque $T_p$ generated by the clockwise rotation of the jaws 116 of the power tong 102 is transferred to the bell cranks 132 at the pivot connections 140 in form of forces $F_{p1}$, $F_{p2}$. The forces $F_{p1}$, $F_{p2}$ are parallel to each other and along opposite directions. The amount of the forces $F_{p1}$, $F_{p2}$ depend on the value of the torque $T_p$ and the distance between the pivot connections 140 and the central axis 101. The forces $F_{p1}$, $F_{p2}$ are transferred along the paths of the crank bells 132, the links 130, and the support legs 124 to the backup tong 124. The stationary backup tong 124 exerts reactions forces along the same paths to the power tong 102 to prevent the power tong 102 from rotating.

As shown in FIG. 1E, the forces $F_{p1}$, $F_{p2}$ are transferred through the bell cranks 132 to the pivot connections 138 in the form of $F'_{p1}$, $F'_{p2}$. The forces $F_{p1}$ and $F'_{p1}$ are of equal amount but along opposite directions. Similarly, the forces $F_{p2}$ and $F'_{p2}$ are of equal amount but along opposite directions. The forces $F'_{p1}$, $F'_{p2}$ are transferred to the links 130 to the support legs 124 in the form of forces $F''_{p1}$, $F''_{p2}$. The support legs 124 are disposed through the sleeves 128 of the backup tong 104. The backup tong 104 holds the support legs 124 in place by exerting reaction forces $F_{r1}$, $F_{r2}$ to the support legs 124 to balance with the forces $F''_{p1}$, $F''_{p2}$. The support legs 124 in turn keep the links 120 and the bell cranks 132 in place, thus prevent the power tong 102 from rotating.

The force $F'_{p1}$ and the force $F_{p1}$ applied to the bell crank 132 produce a torque $T_1$ upon the torque bar 134. The value of torque $T_1$ is determined by the value of the reaction force $F'_{p1}$ and the force $F_{p1}$ and the distance between the joint connection 140 and the torque bar 134 and the distance between the joint connection 138 and the torque bar 134. Similarly, the force $F'_{p2}$ and the force $F_{p2}$ applied to the bell crank 132 produce a torque $T_2$ upon the torque bar 134. The value of torque $T_2$ is determined by the value of the reaction force $F'_{p2}$ and the force $F_{p2}$ and the distance between the joint connection 140 and the torque bar 134 and the distance between the joint connection 138 and the torque bar 134. The torques $T_1$ and $T_2$ are of opposite directions causing the torque bar 134 to twist. In one embodiment, the load cell 142 measures the strain in the torque bar 134 caused by the torques $T_1$ and $T_2$.

The torque $T_1$, $T_2$ exerted on the torque bar 134 are proportional to the power torque $T_p$ exerted on the workstring being made up. The ratio of $T_p$ and $T_1$ is determined by the dimension and geometry of the load transfer assembly 106, which includes the links 120, the crank bells 132, and the torque bar 134. The ratio of $T_p$ and $T_1$ remain consistent once the load assembly 106 is connected between the power tong 102 and the backup tong 104. During operation, the load cell 142 measures the torque $T_1$. The value of the power torque $T_p$ can be determined according to the measurement of torque $T_1$ and the ratio of $T_p$ and $T_1$.

Torque measurements by the load cell 142 may be used to monitor the torque applied to the tubular connection during operation. Monitoring the torque measurements of the load cell 142 may prevent the tubular joints from being too loose or too tight. For example, an upper torque and a lower torque may be used to control the tightness of the joints. For example, during make up, the torque measurement of the load cell 142 may be monitored, continuously rotate the power tong 102 when the measurement is lower than the lower torque and stop the rotation of the power tong 102 or reverse the rotation of the power tong 102 when the torque measurement by the load cell 142 reaches or exceeds the upper torque. Additionally, the torque measurement of the load cell 142 may also be used to achieve uniform tightness among the joints in a tubular string.

Figure 2A:
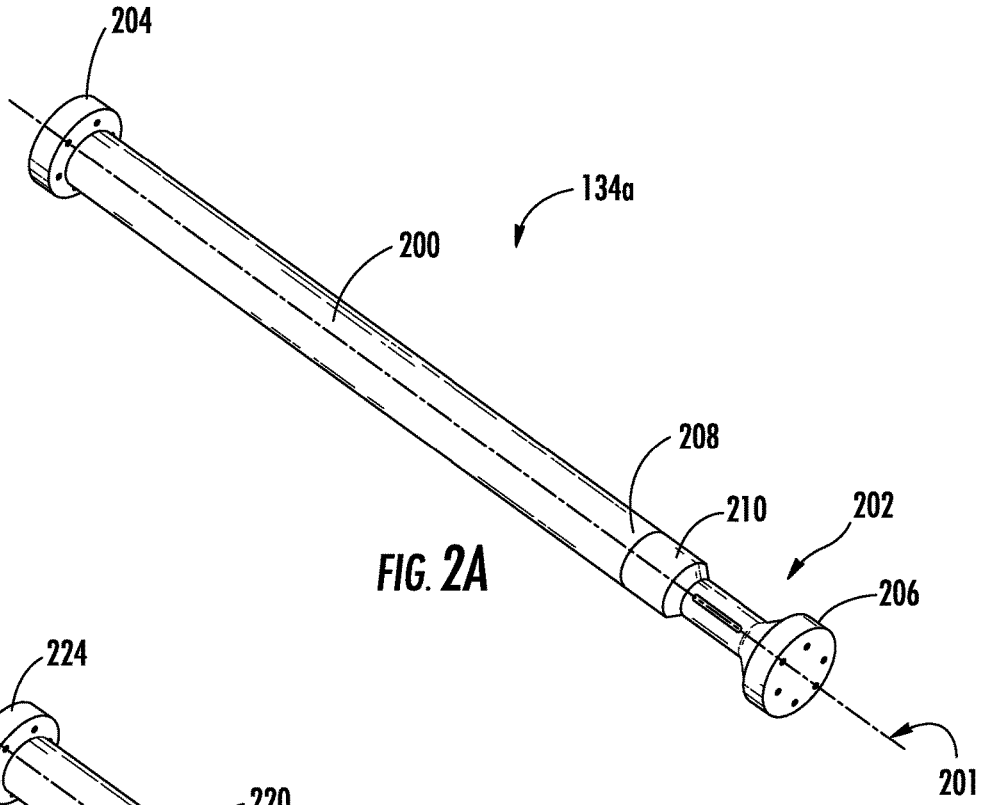
FIG. 2A schematically illustrates a torque bar according to one embodiment of the present disclosure.

FIG. 2A schematically illustrates a torque bar 134*a* according to one embodiment of the present disclosure. The torque bar 134*a* may be used in place of the torque bar 134 in the tong assembly 100. The torque bar 134*a* includes a cylindrical body 200 and a load cell 202. The load cell 202 is coupled to the cylindrical body 200 along a longitudinal axis 201 of the cylindrical body 200. The cylindrical body 200 may have a first end 204 and a second end 208. The first end 204 may be configured to attach to a bell crank, such as the bell crank 132. The second end 208 may be attached to a first end 210 of the load cell 202. A second end 206 of the load cell 202 may be configured to attach to a bell crank, such as the bell crank 132. The load cell 202 and the cylindrical body 200 may be fixedly attached to each other.

Figure 2B:
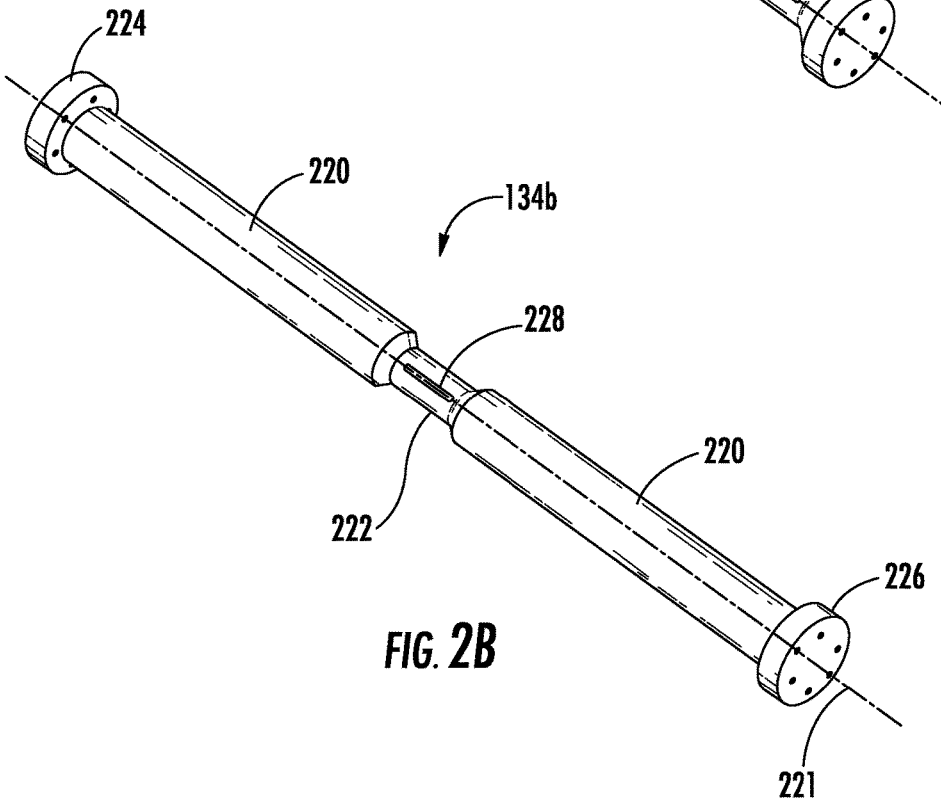
FIG. 2B schematically illustrates a torque bar according to another embodiment of the present disclosure.

FIG. 2B schematically illustrates a torque bar 134*b* according to another embodiment of the present disclosure. The torque bar 134*b* may be used in place of the torque bar 134 in the tong assembly 100. The torque bar 134*b* includes a cylindrical body 220 having a longitudinal axis 221. The cylindrical body 220 may have a first end 224 and a second end 226. The first end 224 and the second end 226 may be configured to attach to bell cranks, such as the bell cranks 132. The cylindrical body 220 may include a sensor section 222 with a reduced diameter. One or more strain sensors 228 may be attached to the sensor section 222 to measure torque exerted on the cylindrical body 220 along the central axis 221.

Figure 3C:
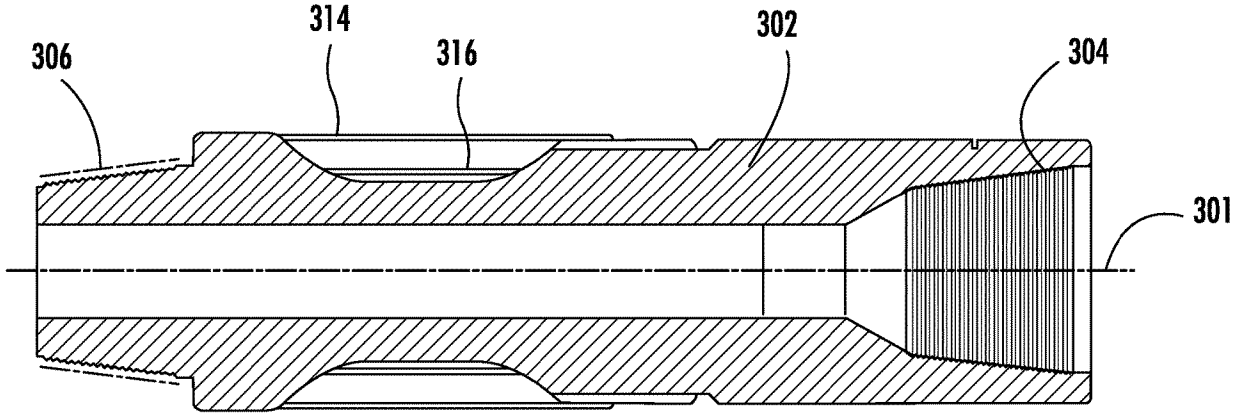
FIGS. 3A-3C schematically illustrate a load cell according to one embodiment of the present disclosure.
Figure 3A:
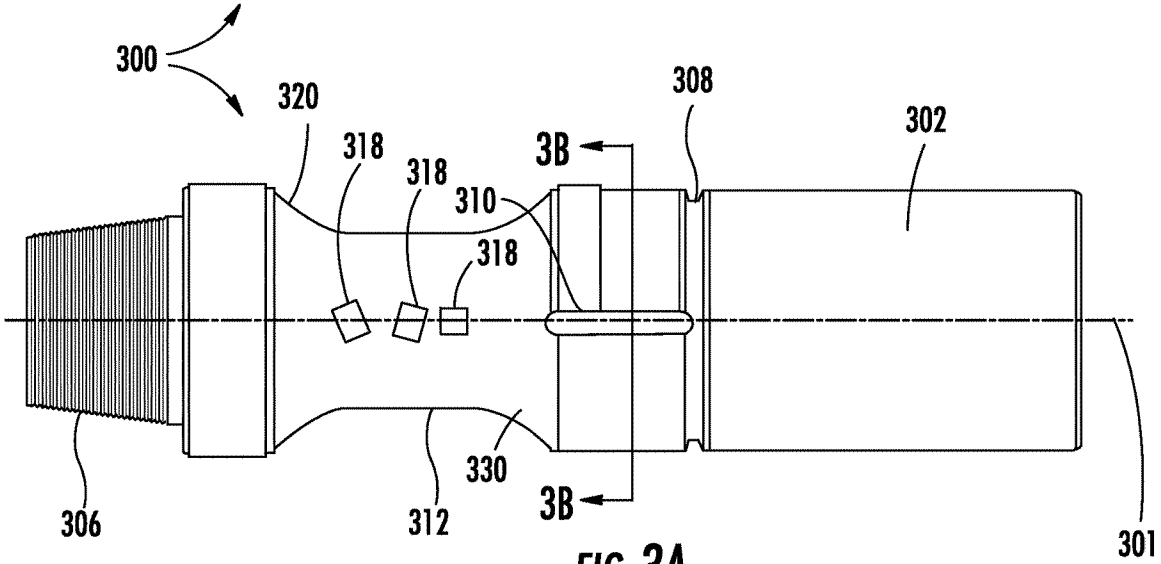
Figure 3B:
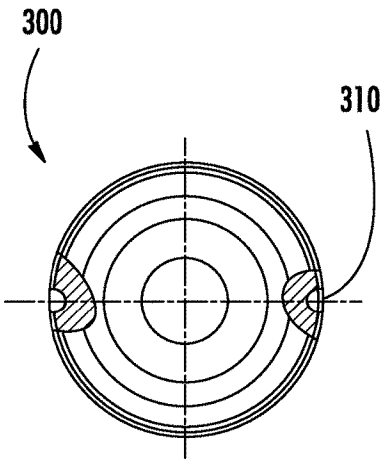

FIGS. 3A-3C schematically illustrate a load cell 300 according to one embodiment of the present disclosure. The load cell 300 may be used in place of the load cells 142, 202 above. FIG. 3A is a schematic side view of the load cell 300 with an outer shield removed. FIG. 3B is a schematic sectional view of the load cell 300. FIG. 3C is a schematic sectional side view of the load cell 300. The load cell 300 may include a cylindrical body 302 having a longitudinal axis 301. The load cell 300 may be configured to measure a torque sustained by the cylindrical body 302 along the longitudinal axis 301.

In one embodiment, the cylindrical body 302 may be a tubular member having a bore therethrough. Alternatively, the cylindrical body 302 may be a solid cylindrical member. Ends of the cylindrical body 302 may include features for connecting with a structure to be measured. In one embodiment, the cylindrical body 302 may include a threaded box 304 and a threaded pin 306 for connection. Other features, such as flanges, may be used for connection. The cylindrical body 302 may include a groove 308 and a reduced diameter portion 312. One or more longitudinal slots 310 may be formed on the cylindrical body 302 between the reduced diameter portion 312 and the groove 308.

One or more strain gages 318 may be attached on an outer surface of the reduced diameter portion 312. The strain gages 318 are disposed on the reduced diameter portion 312 at a sufficient distance from either tapered portions 320 so that stress/strain transition effects at the tapered sections 320 are fully dissipated. Secondary coils for the one or more strain gages 318 may be disposed in the groove 308. The slots 310 provide a path for wiring between the secondary coil disposed in the groove 308 and the one or more strain gages 318.

A shield 316 may be disposed proximate to the outer surface of the reduced diameter portion 312. The shield 316 may be formed a polymer shield, such as a rubber shield or a silicon rubber shield. The shield 316 may be applied as a coating or thick film over the one or more strain gages 318. The shield 316 absorbs any forces that may be otherwise exerted on the one or more strain gages 318. The shield 318 also protects the strain gages 318 from any chemicals present at the well site that may otherwise be inadvertently splattered on the strain gages 318.

A sleeve 314 may be disposed over the reduced diameter portion 312. The cylindrical body 302 may be formed from a metal, such as stainless steel. The sleeve 314 forms a substantially continuous outside diameter of the cylindrical body 302 through the reduced diameter portion 312. The sleeve 314 may be formed from a sheet metal and welded to the cylindrical body 302.

In one embodiment, the load cell 300 may be attached to a cylindrical body to form a torque bar, such as the torque bar 134*a*, to measure a torque sustained by the torque bar. Alternatively, the cylindrical body 302 may have an extended length to function as a torque bar for the tong assembly according to the present disclosure.

Embodiments of the present disclosure provide an apparatus for handling tubular connections. The apparatus comprises a power tong for gripping and rotating a tubular about a central axis, a backup tong for gripping a tubular to prevent rotation, and a load transfer assembly connected between the power tong and the backup tong, wherein the load transfer assembly includes a torque bar having a load cell positioned to measure a torque exerted on the torque bar along a longitudinal axis.

In one or more embodiment of the present disclosure, the load cell is disposed along the longitudinal axis of the torque bar.

In one or more embodiment of the present disclosure, the longitudinal axis of the torque bar is substantially perpendicular to the central axis.

In one or more embodiment of the present disclosure, the load transfer assembly further comprises a first bell crank fixedly coupled to a first end of the torque bar, and a second bell crank fixedly coupled to a second end of the torque bar.

In one or more embodiment of the present disclosure, the first bell crank is pivotably connected to the power tong and the backup tong, and the second bell crank is pivotably connected to the power tong and the backup tong.

In one or more embodiment of the present disclosure, the load cell is integrated into a cylindrical body of the torque bar.

In one or more embodiment of the present disclosure, the load cell is fixedly attached to one end of the torque bar.

In one or more embodiment of the present disclosure, the apparatus further comprises a first support leg and a second support leg, wherein the backup tong is moveably attached to the first and second support legs, and the backup tong is movable along the first and second support legs.

In one or more embodiment of the present disclosure, the load transfer assembly comprises a first link pivotably coupled to the first support leg, a second link pivotably coupled to the second support leg, a first bell crank pivotably coupled to the first link, and a second bell crank pivotably coupled to the second link, wherein a first end of the torque bar is fixedly coupled to the first bell crank, and a second end of the torque bar is fixedly coupled to the second bell crank.

In one or more embodiment of the present disclosure, the power tong comprises first and second alignment posts positioned to align with the first and second support legs respectively.

In one or more embodiment of the present disclosure, the first bell crank is pivotably connected to the power tong and the backup tong, and the second bell crank is pivotably connected to the power tong and the backup tong.

Embodiments of the present disclosure further provide a method for making up or breaking out a tubular connection. The method comprises engaging a first tubular with a power tong, engaging a second tubular with a backup tong, wherein the power tong and the backup tong are connected to a load transfer assembly having a torque bar, rotating the first tubular relative to the second tubular using the power tong to make up or break out a connection between the first tubular and second tubular, and measuring a torque exerted about a longitudinal axis of the torque bar.

In one or more embodiment of the present disclosure, measuring the torque comprising measuring the torque using a load cell disposed along the longitudinal axis of the torque bar.

In one or more embodiment of the present disclosure, the longitudinal axis of the torque bar is substantially perpendicular to the central axis of the tubular connection.

In one or more embodiment of the present disclosure, the method further comprises preventing rotation of the backup tong with first and second support legs coupled to the backup tong.

In one or more embodiment of the present disclosure, the method further comprises allowing the backup tong to move along the first support leg and second support leg.

In one or more embodiment of the present disclosure, the method further comprises stopping the power tong when the measurement of the torque exerted on the torque bar exceeds a predetermined value.

In one or more embodiment of the present disclosure, the method further comprises controlling a torque applied to the connection between the first and second tubular according to the measurement of the torque exerted on the torque bar.

Embodiments of the present disclosure further provide a load transfer assembly for connecting between a power tong and a backup tong. The load transfer assembly comprises a first bell crank pivotably coupled to the power tong and the backup tong, a second bell crank pivotably coupled to the power tong and the backup tong, a torque bar having a first end attached to the first bell crank and a second end attached to the second bell crank, and one or more sensors positioned to measure a torque exerted on the torque bar about a longitudinal axis of the torque bar.

In one or more embodiment of the present disclosure, the torque bar comprises a cylindrical body and a load cell fixedly attached to the cylindrical body, and the one or more sensors are attached to the load cell.

In one or more embodiment of the present disclosure, the torque bar comprises a cylindrical body having a reduced diameter portion, and the one or more sensors are attached to an outer surface of the reduced diameter portion.

In one or more embodiment of the present disclosure, the torque transfer assembly further comprises a first support leg and a second support leg, wherein the backup tong is movably coupled to the first and second support legs.

Embodiments of the present disclosure further provide a method for making up or breaking out a tubular connection. The method comprises engaging a first tubular with a power tong, engaging a second tubular with a backup tong, wherein the power tong and the backup tong are connected by a load transfer assembly, the load transfer assembly comprises a torque bar and a load cell, rotating the first tubular about a central axis relative to the second tubular using the power tong to make up or break out a connection between the first tubular and second tubular, and measuring a torque exerted on the torque bar using the load cell.

Embodiments of the present disclosure further provide an apparatus for handling a first tubular and a second tubular during make up and break out operations. The apparatus includes a power tong for gripping the first tubular and rotating the first tubular about a central axis, a backup tong for gripping the second tubular and preventing rotation of the second tubular, and a load transfer assembly connected between the power tong and the backup tong, wherein the load transfer assembly includes a torque bar having a load cell disposed on a longitudinal axis of the torque bar, and is positioned to measure a torque exerted on the torque bar along the longitudinal axis.

Embodiments of the present disclosure further provide a tong assembly a power tong, a backup tong, and a load transfer assembly coupled between the power tong and the backup tong, wherein the load transfer assembly comprises a first bell crank pivotably coupled to the power tong and the backup tong, a second bell crank pivotably coupled to the power tong and the backup tong, a torque bar having a first end attached to the first bell crank and a second end attached to the second bell crank, and one or more sensors positioned to measure a torque exerted on the torque bar about a longitudinal axis of the torque bar.

Embodiments of the present disclosure further provide an apparatus for handling a first tubular and a second tubular during make up and break out operations. The apparatus comprises a power tong for gripping the first tubular and rotating the first tubular about a central axis, a backup tong for gripping the second tubular, and a load transfer assembly connected between the power tong and the backup tong, wherein the load transfer assembly comprises a torque bar and a load cell configured to measure a torque exerted on the first tubular.

While the foregoing is directed to embodiments of the present disclosure, other and further embodiments may be devised without departing from the basic scope thereof, and the scope of the present disclosure is determined by the claims that follow.

The invention claimed is:

1. A tubular handling and connecting apparatus, comprising:

a power tong;

a backup tong;

a load transfer assembly connected between the power tong and the backup tong, wherein the load transfer assembly includes a torque bar having a load cell positioned to measure a torque exerted on the torque bar about a longitudinal axis of the torque bar; and a first support leg and a second support leg, wherein the backup tong is moveably attached to the first and second support legs, and the backup tong is movable along the first and second support legs.

2. The apparatus of claim 1, wherein the load cell is disposed along the longitudinal axis of the torque bar.

3. The apparatus of claim 2, wherein the load cell is integrated into a cylindrical body of the torque bar.

4. The apparatus of claim 2, wherein the load cell is fixedly attached to one end of the torque bar.

5. The apparatus of claim 1, wherein the longitudinal axis of the torque bar is substantially perpendicular to the central axis.

6. The apparatus of claim 5, wherein the load transfer assembly further comprises:

a first bell crank fixedly coupled to a first end of the torque bar; and a second bell crank fixedly coupled to a second end of the torque bar.

7. The apparatus of claim 6, wherein the first bell crank is pivotably connected to the power tong and the backup tong, and the second bell crank is pivotably connected to the power tong and the backup tong.

8. The apparatus of claim 1, wherein the load transfer assembly comprises:

a first link pivotably coupled to the first support leg;

a second link pivotably coupled to the second support leg;

a first bell crank pivotably coupled to the first link; and a second bell crank pivotably coupled to the second link, wherein a first end of the torque bar is fixedly coupled to the first bell crank, and a second end of the torque bar is fixedly coupled to the second bell crank.

9. The apparatus of claim 1, wherein the power tong comprises first and second alignment posts positioned to align with the first and second support legs respectively.

10. The apparatus of claim 1, wherein the first bell crank is pivotably connected to the power tong and the backup tong, and the second bell crank is pivotably connected to the power tong and the backup tong.

11. A method for making up or breaking out a tubular connection, comprising:

engaging a first tubular with a power tong;

engaging a second tubular with a backup tong, wherein the power tong and the backup tong are connected to a load transfer assembly having a torque bar;

rotating the first tubular relative to the second tubular using the power tong to make up or break out a connection between the first tubular and second tubular;

measuring a torque exerted about a longitudinal axis of the torque bar; and controlling a torque applied to the connection between the first and second tubular according to the measurement of the torque exerted on the torque bar.

12. The method of claim 11, wherein measuring the torque comprising measuring the torque using a load cell disposed along the longitudinal axis of the torque bar.

13. The method of claim 12, wherein the longitudinal axis of the torque bar is substantially perpendicular to the central axis of the tubular connection.

14. The method of claim 13, further comprising preventing rotation of the backup tong with first and second support legs coupled to the backup tong.

15. The method of claim 14, further comprising allowing the backup tong to move along the first support leg and second support leg.

16. The method of claim 11, further comprising stopping the power tong when the measurement of the torque exerted on the torque bar exceeds a predetermined value.

17. A load transfer assembly for connecting between a power tong and a backup tong, comprising:

a first bell crank pivotably coupled to the power tong and the backup tong;

a second bell crank pivotably coupled to the power tong and the backup tong; a torque bar having a first end attached to the first bell crank and a second end attached to the second bell crank; and one or more sensors positioned to measure a torque exerted on the torque bar about a longitudinal axis of the torque bar, wherein the torque bar comprises a cylindrical body and a load cell fixedly attached to the cylindrical body, and the one or more sensors are attached to the load cell.

18. The load transfer assembly of claim 17, further comprising a first support leg and a second support leg, wherein the backup tong is movably coupled to the first and second support legs.

19. A load transfer assembly for connecting between a power tong and a backup tong, comprising:

a first bell crank pivotably coupled to the power tong and the backup tong;

a second bell crank pivotably coupled to the power tong and the backup tong; a torque bar having a first end attached to the first bell crank and a second end attached to the second bell crank; and one or more sensors positioned to measure a torque exerted on the torque bar about a longitudinal axis of the torque bar, wherein the torque bar comprises a cylindrical body having a reduced diameter portion, and the one or more sensors are attached to an outer surface of the reduced diameter portion.

20. The load transfer assembly of claim 19, further comprising a first support leg and a second support leg, wherein the backup tong is movably coupled to the first and second support legs.

* * * * *